US007476357B2

(12) United States Patent
Thut

(10) Patent No.: US 7,476,357 B2
(45) Date of Patent: Jan. 13, 2009

(54) GAS MIXING AND DISPERSEMENT IN PUMPS FOR PUMPING MOLTEN METAL

(76) Inventor: Bruno H. Thut, 16755 Park Circle Dr., Chagrin Falls, OH (US) 44023-4598

( * ) Notice: Subject to any disclaimer, the term of this patent is extended or adjusted under 35 U.S.C. 154(b) by 401 days.

(21) Appl. No.: 11/292,988

(22) Filed: Dec. 2, 2005

(65) Prior Publication Data

US 2006/0180962 A1 Aug. 17, 2006

Related U.S. Application Data

(60) Provisional application No. 60/640,196, filed on Dec. 29, 2004, provisional application No. 60/632,384, filed on Dec. 2, 2004.

(51) Int. Cl.
*C21C 7/072* (2006.01)

(52) U.S. Cl. ..... 266/239; 266/217; 222/603

(58) Field of Classification Search ..... 266/239, 266/217; 222/603; 415/1, 121.2
See application file for complete search history.

(56) References Cited

U.S. PATENT DOCUMENTS

| | | | |
|---|---|---|---|
| 1,865,918 | A | 7/1932 | Junkers |
| 2,472,412 | A | 6/1949 | Fritz |
| 2,808,782 | A | 10/1957 | Thompson et al. |
| 3,048,384 | A | 8/1962 | Sweeney et al. |
| 3,272,619 | A | 9/1966 | Sweeney et al. |
| 3,291,473 | A | 12/1966 | Sweeney et al. |
| 3,715,112 | A | 2/1973 | Carbonnel |
| 3,753,690 | A | 8/1973 | Emley et al. |

(Continued)

FOREIGN PATENT DOCUMENTS

| | | |
|---|---|---|
| CA | 2 528 757 | 6/2006 |

(Continued)

OTHER PUBLICATIONS

"Bimba Position Feedback Cylinders," Brochure, pp. 7.5-6, no date.

(Continued)

*Primary Examiner*—Scott Kastler
(74) *Attorney, Agent, or Firm*—Pearne & Gordon LLP

(57) ABSTRACT

A molten metal pump including a pump base with an inlet and outlet, a mixing impeller chamber for mixing gas and molten metal, a pumping impeller chamber for pumping molten metal. First and second impeller members supported by a shaft are adapted to rotate in mixing and pumping chambers respectively. The impeller members may be integrally formed of a single impeller or separate impellers on one or more shafts. A gas passageway extends from a gas source to the mixing chamber in the base. A gas dispersement pump includes a base with an impeller chamber and inlet and an outlet. An impeller is mounted to a shaft and adapted to be rotated in the impeller chamber. A gas passageway extends from a gas source to a gas outlet proximate to the impeller chamber. A gas dispersement member of porous refractory material is adapted to disperse gas from the gas passageway. In a gas dispersement and gas/molten metal mixing pump, the dispersement member disperses the gas stream entering the mixing chamber where the gas is mixed with molten metal. Molten metal is pumped in the pumping chamber. A gas/molten metal mixture is discharged from the mixing chamber and molten metal is discharged from the pumping chamber.

15 Claims, 4 Drawing Sheets

U.S. PATENT DOCUMENTS

| | | | | |
|---|---|---|---|---|
| 3,836,280 | A | | 9/1974 | Koch |
| 3,886,992 | A | | 6/1975 | Maas et al. |
| 3,984,234 | A | | 10/1976 | Claxton et al. |
| 3,997,336 | A | | 12/1976 | van Linden et al. |
| 4,003,560 | A | | 1/1977 | Carbonnel |
| 4,052,199 | A | | 10/1977 | Mangalick |
| 4,128,415 | A | | 12/1978 | van Linden et al. |
| 4,286,985 | A | | 9/1981 | Van Linden et al. |
| 4,322,245 | A | | 3/1982 | Claxton |
| 4,351,514 | A | | 9/1982 | Koch |
| 4,426,068 | A | | 1/1984 | Gimond et al. |
| 4,456,424 | A | | 6/1984 | Araoka |
| 4,486,228 | A | | 12/1984 | Ormesher |
| 4,491,474 | A | | 1/1985 | Ormesher |
| 4,504,392 | A | | 3/1985 | Groteke |
| 4,518,424 | A | | 5/1985 | Ormesher |
| 4,743,428 | A | | 5/1988 | McRae et al. |
| 4,786,230 | A | | 11/1988 | Thut |
| 5,181,828 | A | | 1/1993 | Gilbert et al. |
| 5,203,681 | A | | 4/1993 | Cooper |
| 5,268,020 | A | | 12/1993 | Claxton |
| 5,312,232 | A | | 5/1994 | Horton et al. |
| 5,330,328 | A | | 7/1994 | Cooper |
| 5,443,187 | A | | 8/1995 | Samuelson |
| 5,468,280 | A | | 11/1995 | Areaux |
| 5,540,550 | A | | 7/1996 | Kubota |
| 5,586,863 | A | | 12/1996 | Gilbert et al. |
| 5,597,289 | A | | 1/1997 | Thut |
| 5,622,481 | A | | 4/1997 | Thut |
| 5,634,770 | A | | 6/1997 | Gilbert et al. |
| 5,662,725 | A | * | 9/1997 | Cooper ..... 222/603 |
| 5,676,520 | A | | 10/1997 | Thut |
| 5,716,195 | A | | 2/1998 | Thut |
| 5,785,494 | A | | 7/1998 | Vild et al. |
| 5,842,832 | A | | 12/1998 | Thut |
| 5,860,575 | A | | 1/1999 | Akin et al. |
| 5,944,496 | A | | 8/1999 | Cooper |
| 5,947,705 | A | | 9/1999 | Mordue et al. |
| 5,951,243 | A | | 9/1999 | Cooper |
| 5,993,728 | A | | 11/1999 | Vild |
| 6,019,576 | A | | 2/2000 | Thut |
| 6,123,523 | A | | 9/2000 | Cooper |
| 6,152,691 | A | | 11/2000 | Thut |
| 6,217,823 | B1 | | 4/2001 | Vild et al. |
| 6,254,340 | B1 | | 7/2001 | Vild et al. |
| 6,303,074 | B1 | | 10/2001 | Cooper |
| 6,439,860 | B1 | | 8/2002 | Greer |
| 6,464,458 | B2 | | 10/2002 | Vild et al. |
| 6,505,674 | B1 | | 1/2003 | Sample et al. |
| 6,524,066 | B2 | | 2/2003 | Thut |
| 6,533,535 | B2 | * | 3/2003 | Thut ..... 415/1 |
| 6,689,310 | B1 | | 2/2004 | Cooper |
| 6,881,030 | B2 | | 4/2005 | Thut |
| 2001/0028846 | A1 | | 10/2001 | Vild et al. |
| 2003/0205854 | A1 | | 11/2003 | Bilodeau et al. |
| 2005/0013715 | A1 | | 1/2005 | Cooper |

FOREIGN PATENT DOCUMENTS

| | | |
|---|---|---|
| GB | 808 444 | 2/1959 |
| GB | 1 424 003 | 2/1976 |
| JP | 63-303014 | 12/1988 |
| JP | 10-05643 | 1/1989 |
| JP | 5-084564 | 4/1993 |
| JP | 8-309514 | 11/1996 |
| JP | 10-277726 | 10/1998 |

OTHER PUBLICATIONS

"Bimba Position Control System," Brochure, pp. 7.25, 7.26, 7.30, no date.

"Elektrak 205," Brochure by Thomson, © 2003 Danaher Motion, pp. D-26, D-27, D-53 and D-54, Dec. 2003.

Scheneider, R., "Working with Position-Feedback Cylinder Technology," http://www.bimba.com/techctr/schneidr.htm, printed May 24, 2005, reprinted from Hydraulics & Pneumatics, Sep. 1996.

Messina, Joseph P., "Pump Handbook," Edited by Karassik, Igor J. et al., pp. 2.213-2.215, no date.

High Temperature Systems, Inc., Chipdog Series, T20002SDGI-40E Circulation Pump, printout from website (www.hitemp.com), 1 page, no date.

Metaullics, J-Series High Capacity Molten Metal Pump (product description), 14 pages, no date.

* cited by examiner

GAS MIXING AND DISPERSEMENT IN PUMPS FOR PUMPING MOLTEN METAL

I. FIELD OF THE INVENTION

The invention relates to the field of pumps designed to pump molten metal and to treat the molten metal with gas.

II. BACKGROUND OF THE INVENTION

One type of pump for pumping molten metal rotates an impeller on the end of a shaft inside an impeller chamber of a base submerged in the molten metal. The impeller chamber may include a volute or may be a nonvolute chamber as disclosed in U.S. Pat. No. 5,203,681. The pump may be used to circulate molten metal or to transfer molten metal. In a circulation pump, a discharge passageway extends from the impeller chamber to an exterior surface of the base. In a transfer pump, the base includes a socket that receives a riser or conduit that extends to another location where it is desired to move the molten metal. The discharge passageway extends from the impeller chamber to the socket.

It has been proposed to introduce reactive and/or inert gas into molten metal for various metallurgical and processing purposes at different locations in and around the pump. For example, gas has been fed into the molten metal along a conduit at a pump discharge passageway downstream of an impeller chamber. However, this design does not efficiently mix the gas and molten metal and unmixed gas can be liberated from the molten metal bath, which wastes gas and can cause safety problems in the case of toxic chlorine gas. Gas has also been introduced along a passageway in a motor driven shaft for release from an impeller mounted to the end of the shaft, inside the impeller chamber. However, this requires effective seals in view of the travel of gas along a rotating shaft. In addition, introducing gas directly into the impeller chamber, while efficiently mixing the gas and molten metal, can cause cavitation that can lead to serious wear or destruction of pump components including the shaft and impeller. Thus, conventional feeding of gas to a pump for molten metal is impractical or inefficient. Gas has also been injected along a lance supported in the molten metal upstream of an inlet protector.

A pump for pumping molten metal proposed in U.S. Pat. No. 4,786,230 by the inventor included two discharge passages extending from an outlet passage. The outlet passage communicates with two impeller chambers. Two impellers were proposed to be mounted on a motor driven shaft for simultaneous rotation in the impeller chambers. The gas was proposed for use in very small quantities for changing the direction of the molten metal flow, not for treating molten metal with gas.

III. DISCLOSURE OF THE INVENTION

The present invention features gas mixing and/or dispersement in pumps for pumping molten metal. A first embodiment features a pump for mixing gas/molten metal and pumping molten metal. Impeller members are disposed in mixing and pumping impeller chambers. The pump can include any suitable impeller, for example: vaned, barrel type, squirrel cage type; rotor or other device for applying force to move molten metal. The impeller can be perforated or not, single or dual intake. Gas travels along a passageway leading from a gas source and is directed into the mixing chamber where it is mixed with molten metal. Molten metal is pumped from the pumping impeller chamber. The mixing chamber is the lower chamber and the pumping chamber is the upper chamber, or vice versa. The upper and lower chambers are stacked and aligned with each other such that a shaft on which the impeller members are supported rotates the impeller members in both impeller chambers. A single impeller that rotates on a single shaft in both chambers is suitable or separate impellers may be used, one in each chamber. The mixing and pumping chambers need not be axially aligned; for example, they can be located beside each other in which case separate shafts could be used. Even if the impeller chambers are stacked and aligned so as to receive one shaft, the impeller members need not be at the same geometric position in each impeller chamber. The pump can include common or separate pump inlets and outlets extending to and leading from the impeller chambers. These inlets and outlets can be located at different positions or at the same position in one impeller chamber compared to another impeller chamber.

The first and second impeller chambers can be isolated from significant molten metal communication between them using a web or gasket in the base that separates the first and second impeller chambers and a close tolerance between the impeller and web. Suitable bearing components on the shaft, impeller and components that contact the shaft and impeller, may be used in the present invention in a known manner. The first and second impeller chambers can include a generally spiral shaped volute as known in the art or they can be nonvolute. One impeller chamber can include a volute and the other can be a nonvolute impeller chamber. In a particular aspect of the invention a volute is disposed in both impeller chambers. The volute may be an integral part of the pump that is machined into it or it may be an insert used in the impeller chamber. Volutes offer the advantage of increased pumping efficiency or greater pumping flow rates compared to pumps having no volute. All pump components that are subjected to the molten metal environment are composed of materials suitable for this purpose, for example, graphite or silicon carbide, or other suitable refractory or nonmetallic material.

Gas that is directed into the mixing chamber can cause cavitation. Cavitation is normally disadvantageous to pumps and pump components due to the wear or damage it imposes on them. However, while not wanting to be bound by theory, in the present invention the detrimental effects of cavitation in the gas/molten metal mixing chamber are counterbalanced by rotating the impeller in the pumping chamber where there is no significant cavitation. Even if there are some detrimental effects of cavitation in the mixing chamber, it is expected to be minimal. The invention is believed to provide superior mixing of gas and molten metal and pumping efficiency compared to the gas injection pump system where gas is injected at the discharge of the base. Thus, the invention may provide economic and performance advantages compared to gas injection pumps that are currently on the market.

A second embodiment of the invention features a gas dispersement pump for dispersing gas that is introduced into the molten metal. While not wanting to be bound by theory, a gas stream is dispersed into bubbles of gas in the molten metal that enter an impeller chamber of the base. This embodiment of the invention employs an impeller, one or more volute or nonvolute impeller chambers and base inlet and outlet as described above.

A gas conduit extends from a gas source and has an outlet located at the inlet protector for directing gas into the impeller chamber. Alternatively, the gas conduit may extend directly into the base. Near the outlet of the gas conduit is disposed a porous gas dispersement member composed of porous graphite, sintered silicon carbide or other suitable porous refractory material adapted to disperse gas from the gas conduit. The dispersement of the gas reduces or eliminates cavitation in the impeller chamber.

Molten metal pumps are known that include a shaft sleeve at the inlet to the base of the pump. The shaft sleeve can be supported on a shoulder formed in the base and can be used to support bearing rings that can contact the shaft, impeller or bearings thereon. Also known is an inlet protector as disclosed in U.S. Pat. No. 6,533,535 by the inventor, which is incorporated herein by reference in its entirety. The inlet protector can be a sleeve that includes a plurality of openings that permit passage of molten metal and small articles into the base and prevent passage of other articles that are larger than the openings. The inlet sleeve differs from prior porous filters located at the inlet of the base in that porous inlet filters have high surface area and may tend to clog excessively. The gas dispersement member of the present invention is disposed near the outlet of the gas conduit. The inlet protector sleeve is configured to enable fastening and removal of the conduit or gas dispersement member to it. Dispersed gas (e.g., gas bubbles) are introduced from the inlet sleeve into the base inlet as described above.

Many variations are possible within the scope of the present invention. For example, the gas dispersement member may be attached to an end of the gas conduit or to the inlet protector. The gas dispersement member can have various configurations including a ring or circular disk. The entire inlet protector, or a portion thereof, may be formed of porous refractory material and function as the gas dispersement member. Rather than fastening to the inlet protector, the gas conduit may extend directly into the base in communication with a gas passageway formed in the base and leading to the impeller chamber. In this aspect, the gas dispersement member can be a disk connected to the end of the gas conduit.

The gas dispersement member of the present invention is usable in connection with a pump base that includes one or more impeller chambers. For example, the gas dispersement member and gas conduit may be fastened to a pump base that includes the gas mixing and molten metal pumping impeller chambers described in the first embodiment.

Various gases are suitably mixed or dispersed into the molten metal according to the present invention, including inert gases, reactive gases or combinations thereof. Inert gases include argon and nitrogen. A suitable reactive gas is chlorine gas. In addition, gases in which solid particles are entrained may also be suitable for use in the present invention. Suitable molten metal includes, for example, aluminum alloys. In a preferred form of the invention, scrap aluminum alloy containing a relatively high concentration of magnesium, for example from aluminum can scrap, can be melted to form the molten metal. By injecting chlorine gas into the molten metal, the magnesium may be removed as a magnesium chloride compound. Nitrogen gas may remove aluminum oxides from the molten metal. Silicon can be added to the molten metal, to make die cast parts used in the automotive industry.

The present invention offers numerous advantages. Molten metal can be pumped more efficiently leading to more economical production of metal articles. More efficient mixing of the gas and the molten metal may reduce the cost of production by using less gas. The invention also may reduce liberation of toxic chlorine gas, providing a safer work environment.

IV. BRIEF DESCRIPTION OF THE DRAWINGS

V. DETAILED DESCRIPTION

Figure 1:
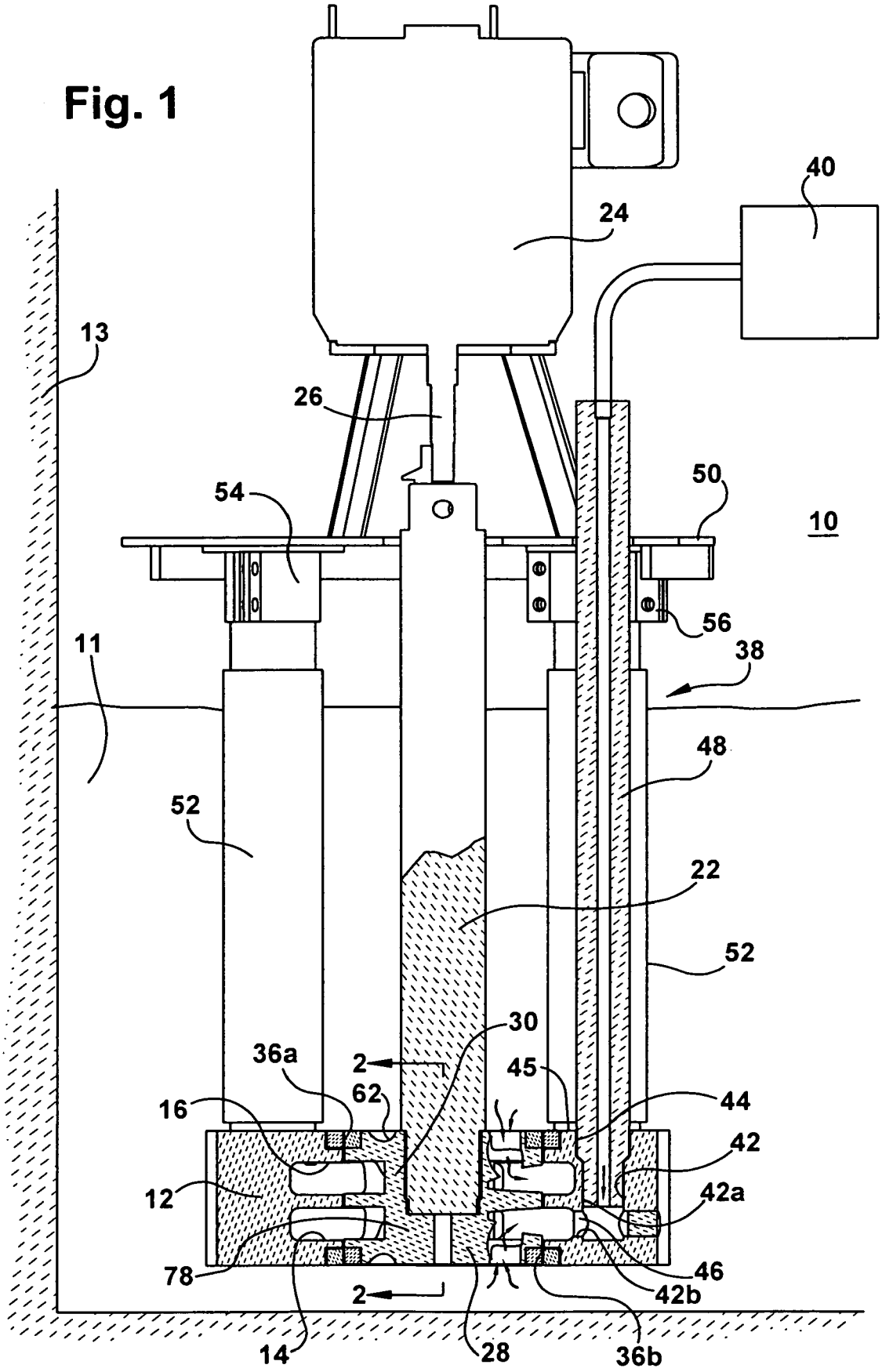
FIG. 1 is a vertical cross-sectional view of a pump for gas and molten metal mixing and molten metal pumping, which is constructed in accordance with the present invention.
Figure 2:
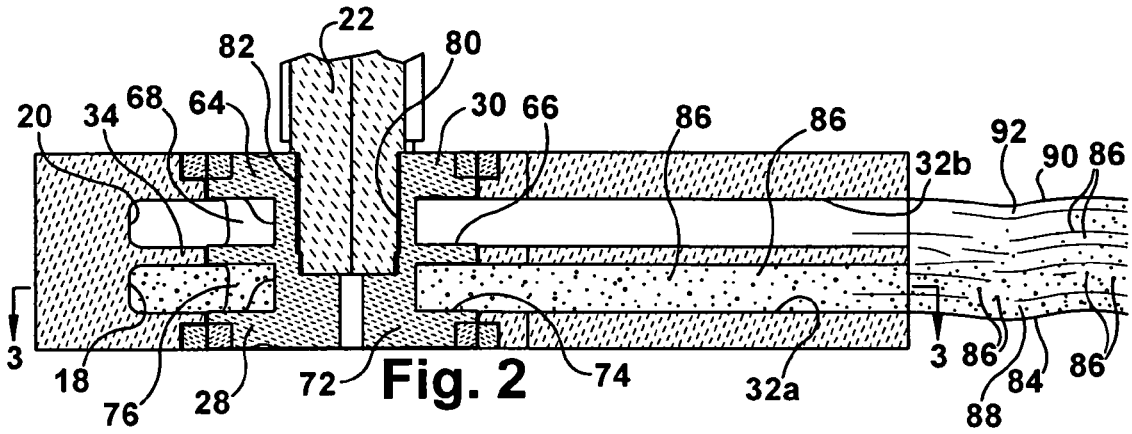
FIG. 2 is a cross-sectional view as seen along the plane designated 2-2 in FIG. 1.

Referring now to the drawings, FIG. 1 shows a pump 10 for gas/molten metal mixing and molten metal pumping. The pump has a base 12 submerged in a bath of molten metal 11 contained by a vessel 13. The base includes a gas/molten metal mixing impeller chamber 14 and a molten metal pumping impeller chamber 16. A volute 18 forms a part of the mixing chamber and a volute 20 forms a part of the pumping chamber (FIG. 2). A shaft 22 is rotatably driven by a motor 24. A motor drive shaft 26 is coupled to the shaft 22 in a known manner. Impeller members 28, 30 connected to the shaft are located in the mixing chamber 14 and pumping chamber 16, respectively. The pump includes an outlet formed by a first discharge passageway 32*a* extending from the mixing impeller chamber and a second discharge passageway 32*b* extending from the pumping impeller chamber (FIG. 2). In this example, the first and second discharge passageways are configured and arranged the same. The mixing and pumping chambers are isolated from fluid communication with each other via a web 34 of the base disposed between the chambers and close tolerance between the impeller and the web. A base inlet includes an upper inlet opening 36*a* and a separate lower inlet opening 36*b*.

A gas passageway 38 extends from a gas source 40 to near the mixing chamber. The gas passageway includes a base passageway 42 extending from a gas inlet opening 44 located at the exterior surface 45 of the base and a gas outlet 46 located in an interior of the base near the mixing chamber, and a gas conduit 48 extending from the gas source into fluid communication with the gas inlet. The gas conduit 48 may be a lance, flux tube or other suitable structure known in the art that can be used to direct gas, formed of a suitable refractory material (e.g., graphite). The base passageway 42 includes a vertical passage 42*a* extending from the base exterior and a horizontal passage 42*b* extending from the vertical passage to the mixing chamber. The horizontal passage outside of the intersection with the vertical passage is plugged after drilling. Gas travels from the gas source 40 along the gas conduit 48, through the base passageway 42 and into the mixing chamber 14. The gas may be any suitable reactive or inert gas including nitrogen, argon, chlorine and combinations of gases. The gas can also include entrained solid material.

The pump includes a motor mount 50 as known in the art for supporting the motor. Upper ends of posts 52 are clamped by clamps 54 to the motor mount. Lower ends of the posts are cemented into bores of the base in a known manner. An upper end portion of the gas conduit is clamped by clamp 56 to the motor mount.

Figure 3:
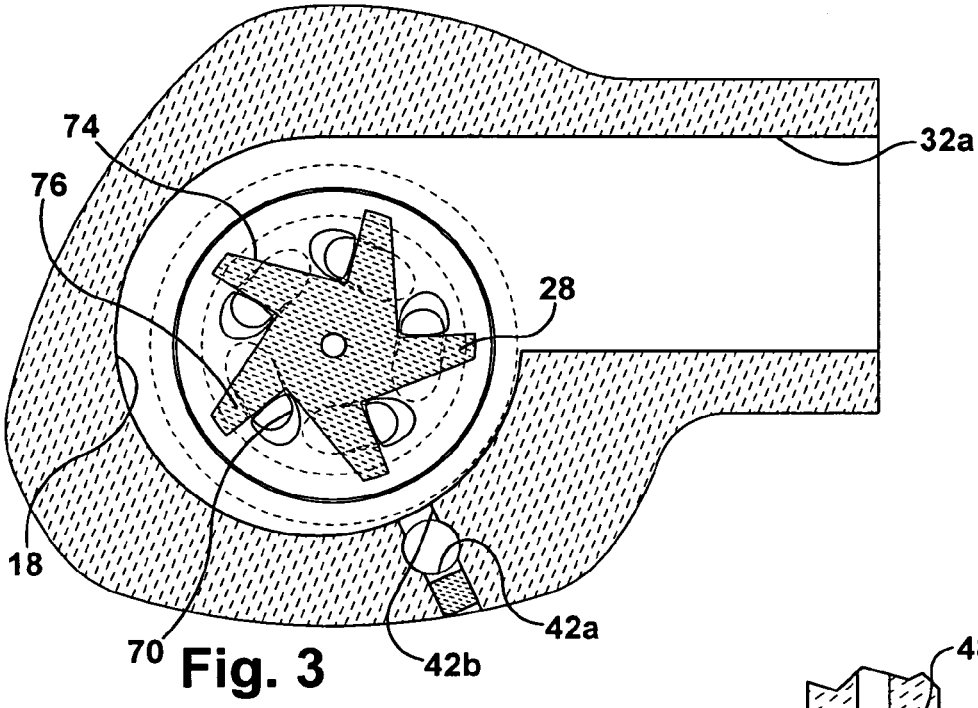
FIG. 3 is a cross-sectional view as seen along the plane designated 3-3 in FIG. 2.

Upper and lower impeller members 30, 28, respectively, are adapted to be rotated in the pumping 16 and mixing chambers 14, respectively. The impeller members may be perforated dual intake, vaned or barrel impellers of the type described in U.S. Pat. No. 6,881,030, which is incorporated herein by reference in its entirety. A suitable dual intake baffle impeller is disclosed in U.S. Patent Application Ser. No. 60/650,499, which is incorporated herein by reference in its entirety. The upper impeller member 30 includes inlet openings 62 (FIG. 1) in an upper portion 64 of the impeller member and cavities 66 between vanes 68 at the side of the upper impeller member (FIG. 2). The lower impeller member 28 includes inlet openings 70 (FIG. 3) in a lower portion 72 of the impeller member and cavities 74 between vanes 76 at the side of the lower impeller member. The impeller inlet openings 62, 70 are in fluid communication with the cavities 66, 74, respectively. The upper and lower impeller members are integrally formed components of a single baffle impeller 78 mounted to the shaft as disclosed in the 60/650,499 application. The impeller includes a threaded bore 80 that engages the threads 82 of the shaft. Alternatively, the upper impeller member may be separate from the lower impeller member, each separate impeller being mounted to the shaft. Upon rotation of the shaft and rotation of the upper and lower impeller members in the pumping and mixing chambers, the molten metal enters the upper and lower impeller members through the impeller inlet openings 62, 70, travels through the cavities 66, 74 and out the upper and lower discharge passageways 32*b*, 32*a*, respectively.

More specifically, upon rotation of the lower impeller member 28 in the mixing chamber 14, the gas and molten metal are efficiently mixed and a mixture of the gas and molten metal travels out the lower discharge passageway 32*a*. Although cavitation may occur in the mixing chamber it is generally absent in the pumping chamber. While not wanting to be bound by theory, rotation of the impeller in the pumping chamber counterbalances forces of cavitation in the mixing chamber. Thus, while efficient mixing of gas and molten metal occurs, via cavitation or without cavitation in the mixing chamber, the balanced rotation of the pumping impeller lessens detrimental effects of cavitation or unbalancing of the impeller member in the mixing chamber.

While not wanting to be bound by theory, gas bubbles 86 from a lower discharge stream 84 composed of the mixture of gas 86 and molten metal 88 tends to rise into the upper stream 90 of molten metal 92, which further mixes the gas and molten metal. FIG. 2 is provided for improving understanding of the invention and should not be used to limit the scope of the preset invention. For example, it will be understood that the gas might be dissolved and not in the form of bubbles 86. The actual location, quantity and distribution of gas in the molten metal and size and shape of the actual gas/molten metal stream 84 and molten metal stream 90 might be different than what is depicted in FIG. 2.

The impeller is constructed and arranged so as to simultaneously rotate in both impeller chambers. Alternatively, the impeller may be positioned by vertical movement of the shaft so as to rotate in the mixing chamber only, in the pumping chamber only, in a transfer chamber only or in two impeller chambers simultaneously as disclosed in U.S. Patent Application Ser. No. 60/696,665 and 60/659,356, which are incorporated herein by reference in their entireties. The impeller can be rotated only in the mixing chamber, and not in any other chamber, when little or no cavitation results from introducing gas into the mixing chamber.

Figure 5:
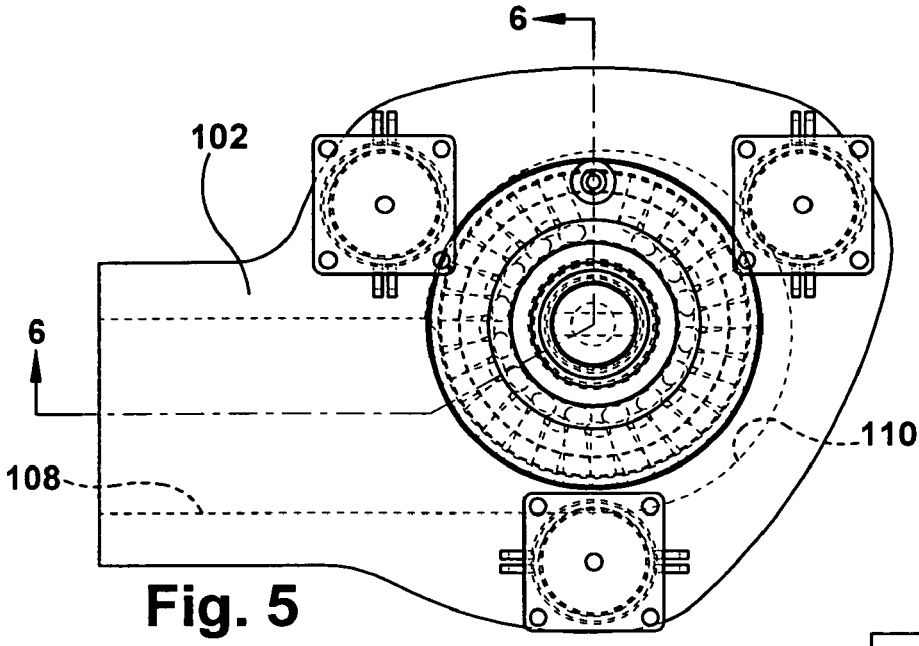
FIG. 5 is a top plan view of a second pump constructed in accordance with the present invention.
Figure 6:
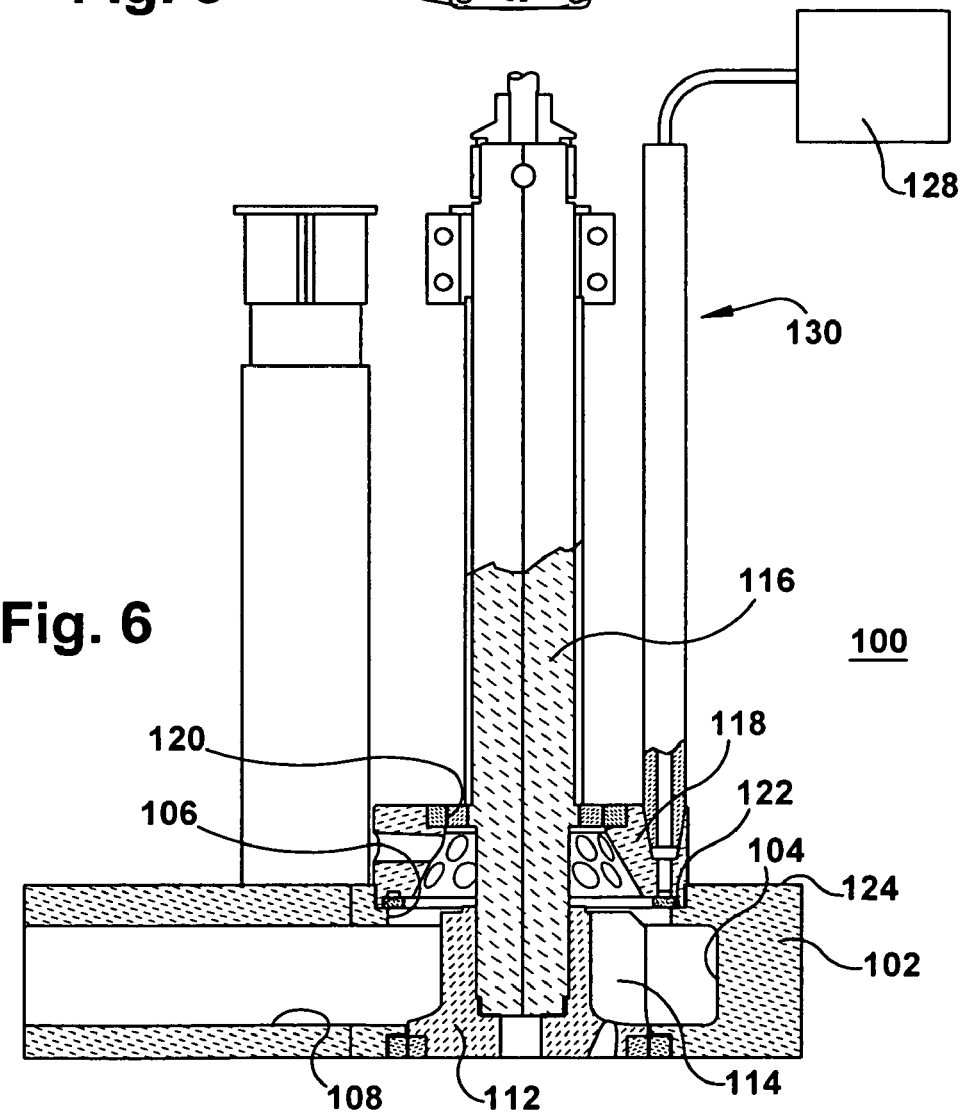
FIG. 6 is a cross-sectional view as seen along the plane designated 6-6 in FIG. 5.
Figure 7:
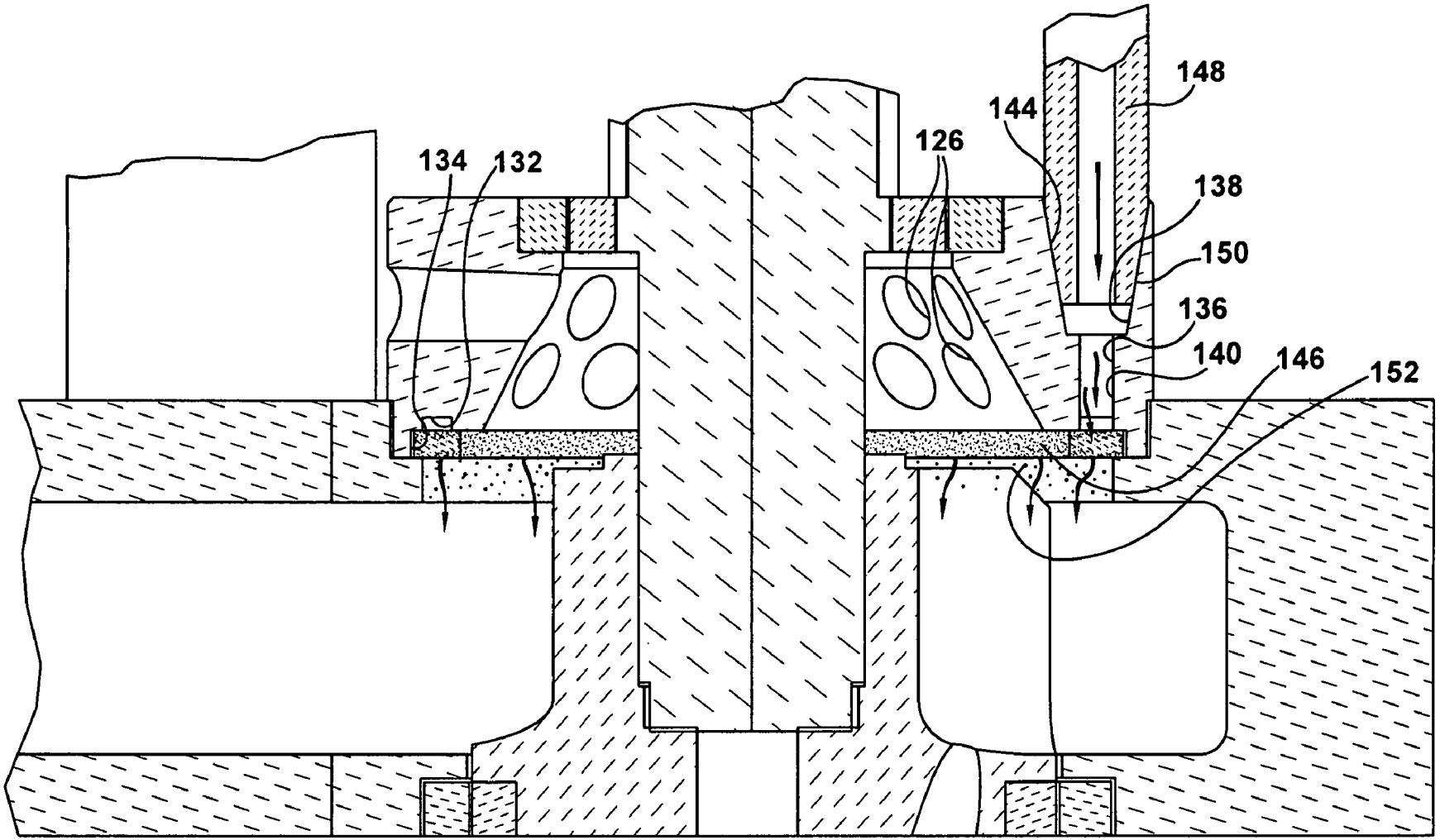
FIG. 7 is an enlarged view of a portion of the pump shown in FIG. 6.

Referring to FIGS. 5-7, where like parts have the same reference numerals throughout the drawings, a gas dispersement pump 100 is disposed in a vessel 13 containing a molten metal bath 11 and includes a pump base 102 having an impeller chamber 104, molten metal inlet 106 and molten metal discharge passageway 108. The impeller chamber includes a volute 110 that has a generally spiral shape in top plan view (FIG. 5). An impeller 112 includes vanes 114, such as the impeller disclosed in U.S. Pat. No. 5,597,289, which is incorporated herein by reference in its entirety. The impeller is connected to a motor driven shaft 116 and positioned to be located in the volute of the impeller chamber. An inlet protector or guard sleeve 118 has a central opening 120 for receiving the shaft. The inlet protector is disposed at the base inlet and rests on an annular shoulder 122 formed in an upper surface 124 of the base. The inlet protector includes a plurality of openings 126 that prevent passage of particles larger than the opening size into the impeller chamber of the pump. The size and shape of the openings can vary depending on the size of the pump and size of the debris desired to be excluded from the pump. The inlet protector prevents particles or objects from entering the impeller chamber and jamming the impeller, which otherwise could damage or destroy the impeller and shaft. One example of an inlet protector that can be modified as disclosed herein for use in the present invention is disclosed in the U.S. Pat. No. 6,533,535, which is incorporated herein by reference in its entirety.

A gas source 128 is disposed outside the molten metal and may be fastened to a support plate or motor mount as shown in FIG. 1. A gas passageway 130 extends from the gas source to near the impeller chamber. The inlet protector sleeve includes an annular gas groove 132 and an annular seating groove 134 (FIG. 7). A gas passage 136 extends in the inlet protector from a gas inlet opening 138 near the upper surface of the base to a gas outlet opening 140 near the impeller chamber. A conical seating orifice 144 is disposed near the gas inlet. A gas dispersement member 146 in the form of a ring composed of porous refractory material is cemented in the annular seating groove 134 below the gas groove 132. The gas groove 132 is in fluid communication with the outlet 140 of the gas passageway. Gas conduit 148 has a conical end surface 150 that is received in the conical seating orifice 144. Downward pressure on the gas conduit in the seating orifice and clamping of the upper end of the conduit to the motor mount as shown in FIG. 1, enables the conduit to securely engage the base for directing the gas into the impeller chamber as well as to be rapidly replaced without removing the pump from the molten metal. The gas passageway 130 is comprised of the gas conduit 148, gas passage 136 of the inlet protector and gas groove 132. Gas travels from the gas source 128 along the gas conduit, through the gas passage of the inlet protector, around the circumference of the annular gas groove, around the circumference of the gas dispersement ring and out the inlet protector. The distribution of the gas around the circumferences of the gas groove and dispersement member is depicted by arrows in FIG. 7. Travel of the gas around the circumference of the gas groove enables equal distribution of the gas around the circumference of the gas dispersement ring and equal distribution into the impeller chamber. Gas is dispersed by the gas dispersement ring into small bubbles 152. It will be appreciated that the number, location, size and position of the bubbles is shown in FIG. 7 for improving understanding and may vary from what occurs during operation of the pump.

It will be appreciated by those of ordinary skill in the art in view of this disclosure that the gas dispersement member may be formed in various geometric shapes, of various materials and positioned in different locations in the inventive pump, while being effective to disperse gas. The gas dispersement member may be square, circular, cylindrical, annular or other shape. The material of the gas dispersement member is any refractory material that disperses a stream of gas (e.g., into small bubbles), including porous graphite or sintered silicon carbide. One suitable material is porous sintered silicon carbide material of which the inlet filters used on Pyrotek or Metaullics pumps are composed. Moreover, while the gas dispersement member is shown used in a base having a single impeller chamber (FIG. 7), it can be used in a base having two or more impeller chambers. The gas passageway can extend to different pump components and to different locations of the base. For example, the gas conduit can extend to an upper mixing chamber rather than to a lower mixing chamber shown in FIG. 1. In another variation of the invention the entire inlet protector is formed of porous refractory material that disperses gas from the gas passageway.

Figure 4:
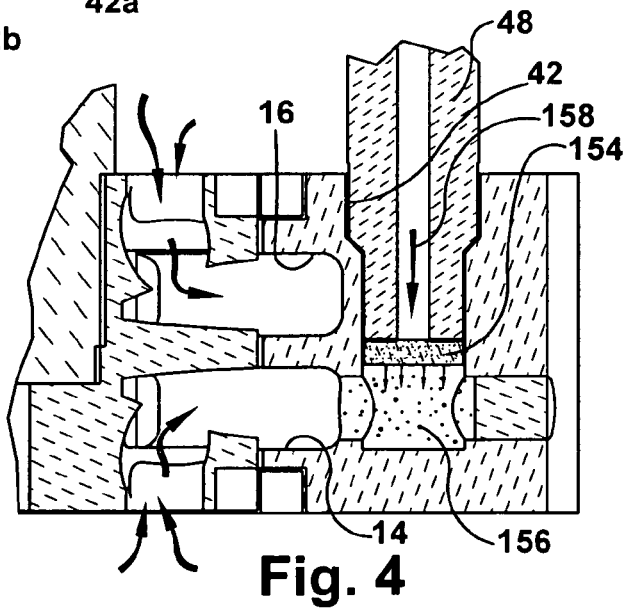
FIG. 4 is a variation of the pump shown in FIG. 1.

In another aspect of the invention shown in FIG. 4, the gas dispersement member is in the form of a circular disk 154 disposed at the end of the gas conduit. The gas dispersement disk can be cemented to the end of the gas conduit. The gas dispersement disk 154 evenly disperses the gas from the gas conduit as shown by the arrows in FIG. 4. The gas is dispersed into small bubbles 156 that enter the mixing chamber 14. Although other aspects of the pump are the same as the pump shown in FIG. 1, this figure is referred to for showing another variation of the gas dispersement member. The pump can include the base passageway, gas conduit and cemented gas dispersement disk in a base having only a single mixing impeller chamber rather than a an additional pumping chamber as shown in FIG. 4. The gas conduit extends into the conical orifice of the base as shown in the first embodiment (FIG. 1), but the cemented gas dispersement disk extends into the vertical portion 42*a* of the base passageway 42.

Another aspect of the invention effectively combines features of the first and second embodiments resulting in a pump that disperses gas, mixes gas/molten metal and pumps molten metal (FIG. 4). A gas stream 158 travels from the gas source down the gas conduit 48 and is dispersed by the gas dispersement disk 154 into small bubbles 156. The gas bubbles enter the mixing chamber 14. Rotation of the impeller member causes molten metal to enter the mixing chamber and further mix the gas bubbles in the mixing chamber. The molten metal and gas mixture is then discharged from the base through discharge passageway 32*a*. Rotation of the impeller causes molten metal to be pumped from the pumping chamber 16. This design may avoid cavitation or unbalancing of the impeller in the mixing chamber. The impeller could be rotated in the mixing chamber alone or in the pumping chamber alone. In addition, the pumping chamber could be a transfer impeller chamber. Therefore, one of ordinary skill in the art will appreciate in view of this disclosure that numerous variations of the inventive pump are possible including a pump that operates to achieve gas/molten metal mixing, gas/molten metal mixing and pumping, and gas/molten metal mixing and transfer. The gas dispersement pump of the present invention is expected to advantageously maximize mixing of the gas in the molten metal while maintaining pumping efficiency and performance.

What is claimed is:

1. A pump for mixing gas and pumping molten metal, comprising:

a base adapted to be submerged in a bath of the molten metal, comprising an inlet and an outlet, a mixing impeller chamber adapted to mix gas and molten metal, a pumping impeller chamber adapted to pump molten metal, and said inlet and said outlet being in fluid communication with at least one of said mixing chamber and said pumping chamber, and a shaft adapted to be rotatably driven;

a first impeller member supported by said shaft adapted to rotate in said mixing chamber;

a second impeller member supported by said shaft adapted to rotate in said pumping chamber;

a source of gas; and a gas passageway extending from said gas source into proximity to said mixing chamber in said base.

2. The pump of claim 1 wherein said outlet includes a discharge passageway extending from both said mixing chamber and said pumping chamber to an exterior surface of said base.

3. The pump of claim 1 wherein said outlet includes a first discharge passageway extending from said mixing chamber to an exterior surface of said base and a second discharge passageway extending from said pumping chamber to said exterior surface, said first discharge passageway being isolated from fluid communication with said second discharge passageway.

4. The pump of claim 1 wherein said first impeller member and said second impeller member are components of one impeller supported by said shaft.

5. The pump of claim 1 wherein an inlet protector is disposed around said shaft so as to obturate said inlet, said inlet protector including a plurality of openings that are configured and arranged effective to prevent debris in the molten metal from entering said base.

6. The pump of claim 1 wherein said mixing chamber and said pumping chamber both include a wall that forms a volute.

7. The pump of claim 1 wherein said mixing chamber is located below said pumping chamber.

8. The pump of claim 1 wherein said gas passageway comprises a base passageway extending from a gas inlet located near an exterior surface of said base and a gas outlet located in an interior of said base near said mixing chamber, and a gas conduit extending from said gas source into fluid communication with said gas inlet.

9. A pump for mixing gas and pumping molten metal, comprising:

a base adapted to be submerged in a bath of the molten metal, said base comprising an inlet and an outlet, a mixing impeller chamber adapted to mix gas and molten metal, a pumping impeller chamber adapted to pump molten metal, said mixing chamber and said pumping chamber being stacked over each other, and said inlet and said outlet being in fluid communication with at least one of said mixing chamber and said pumping chamber;

a shaft adapted to be rotatably driven extending into said mixing chamber and said pumping chamber;

a first impeller member supported on said shaft and adapted to rotate in said mixing chamber effective to cause molten metal to flow into said base along a molten metal inlet direction;

a second impeller member supported on said shaft and adapted to rotate in said pumping chamber;

a source of gas; and a gas conduit extending from said gas source adapted to direct said gas along said molten metal inlet direction into said mixing chamber.

10. A pump for dispersing gas and mixing gas and molten metal, comprising:

a base adapted to be submerged in a bath of the molten metal comprising an inlet and an outlet, a mixing impeller chamber adapted to mix gas and molten metal, a pumping impeller chamber adapted to pump molten metal, and said inlet and said outlet being in fluid communication with at least one of said mixing chamber and said pumping chamber;

a shaft adapted to be rotatably driven;

a first impeller member supported on said shaft adapted to rotate in said mixing chamber;

a second impeller member supported on said shaft adapted to rotate in said pumping chamber;

a source of gas; and a gas passageway extending from said gas source and including an outlet located near said mixing impeller chamber; and a gas dispersement member composed of porous refractory material adapted to disperse gas from said gas passageway.

11. The pump of claim 10 comprising an inlet protector disposed around said shaft so as to obturate said base inlet, said inlet protector including a plurality of openings that are configured and arranged effective to prevent debris in the molten metal from entering said base, said gas passageway including a gas conduit fastened to said inlet protector.

12. The pump of claim 11 wherein said gas dispersement member includes a ring mounted to said inlet protector and said gas conduit directs the gas from said gas outlet to said ring.

13. The pump of claim 11 wherein said inlet protector is said gas dispersement member.

14. The pump of claim 11 wherein said inlet protector includes said gas dispersement member as an insert.

15. A pump for dispersing gas and pumping molten metal, comprising:

a base adapted to be submerged in a bath of the molten metal comprising an inlet and an outlet, a mixing impeller chamber adapted to mix gas and molten metal, a pumping impeller chamber adapted to pump molten metal, and said inlet and said outlet being in fluid communication with at least one of said mixing chamber and said pumping chamber;

a shaft adapted to be rotatably driven;

an impeller supported on said shaft adapted to rotate in either one or both of said mixing chamber and said pumping chamber;

a source of gas; and a gas passageway extending from said gas source and including an outlet that directs gas into said mixing impeller chamber; and a gas dispersement member at said outlet of said gas passageway composed of porous refractory material adapted to disperse gas into small bubbles that are directed into said mixing impeller chamber.

* * * * *